US005924379A

United States Patent [19]

Masini et al.

[11] Patent Number: 5,924,379

[45] Date of Patent: Jul. 20, 1999

[54] ACTUATING MECHANISM WITH IMPROVED MOUNTING STRUCTURE

[75] Inventors: Christopher P. Masini; Jason B. Starling, both of Stillwater; Rodney M. Caldwell, Pawnee, all of Okla.

[73] Assignee: Brunswick Corporation, Lake Forest, Ill.

[21] Appl. No.: 09/020,772

[22] Filed: Feb. 9, 1998

[51] Int. Cl.[6] ..... B63H 25/22; B63H 20/12

[52] U.S. Cl. ..... 114/150; 92/169.1; 440/61

[58] Field of Search ..... 114/150; 440/61; 92/169.1, 169.2

[56] References Cited

U.S. PATENT DOCUMENTS 3,116,710 1/1964 Cass ..... 440/61

3,626,467 12/1971 Mazziotti ..... 440/61

*Primary Examiner*—Sherman Basinger

*Attorney, Agent, or Firm*—William D. Lanyi

[57] ABSTRACT

An actuating mechanism is provided with support members that extend away from the centerline of a cylinder bore, piston and actuator rod of an actuation mechanism that uses pressure to move the piston within a cylinder bore. Two support members are attached to a cylinder housing and provided with mounting holes. The two support members are spaced apart from the cylinder housing to allow external support structures to be placed between the cylinder housing and the two support members. Appropriate fasteners, such as bolts, attach each of the two support members to the external support structures in such a way that the cylinder housing can pivot about an axis extending through both bolts. Most importantly, a line extending through the supporting bolts intersect the cylinder bore at a place between its opposing ends. This reduces the required space necessary to allow the cylinder to pivot properly.

14 Claims, 5 Drawing Sheets

ACTUATING MECHANISM WITH IMPROVED MOUNTING STRUCTURE

BACKGROUND OF THE INVENTION

1. Field of the Invention

The present invention is generally related to an actuating mechanism, such as a hydraulic or pneumatic cylinder and, more particularly, to a hydraulic cylinder used to actuate a steering lever of a marine propulsion device in which the cylinder is provided with support members attached to the cylinder's housing structure. The support members are located outboard from the structure to allow external support structures to be located between the cylinder housing and the two support members.

2. Description of the Prior Art

Many different types of hydraulic and pneumatic cylinders are very well known to those skilled in the art and widely used for many actuating applications. The cylinders typically comprise a housing structure with a cylinder bore formed therein. A piston is placed within the bore and is slideable within the bore in response to changes in the relative pressures on the two opposing sides of the piston. A rod is attached to the piston and extends through the cylinder housing at one end of the bore. The rod can be attached to a mechanism that is actuated by the cylinder.

Some type of valve means is normally used to control the flow of a fluid into and out of the cylinder bore at opposite sides of the piston to change its direction of travel. Many different ways have been used to mount the actuating mechanism to a stationary device in order to exert a force, through the rod, between the mounted cylinder housing and a component attached to a distal end of the rod. It is generally recommended that the actuating mechanism be mounted so that resulting forces are contained within the cross-sectional area of the rod so that bending moments can be minimized. This can best be accomplished if the cylinder housing is mounted in such a way that the resulting forces extend through the rod and the point where the cylinder housing is attached to a stationary component.

One problem that exists with known actuating mechanisms of this type occurs when the cylinder housing is used in conjunction with a clevis, as its stationary mounting mechanism, and a severely limited space is available for the cylinder housing to extend in a direction away from the clevis and the rod which is attached to its piston. When mounted on a clevis structure, the cylinder housing is generally of such a size that sufficient space is not available between the clevis ears to provide enough room to allow mounting bolts to be properly used. As a result, known actuating mechanisms of this type are typically mounted with the full length of the cylinder bore extending in one direction from the clevis and the rod extending between the clevis ears and in an opposite direction. Unfortunately, this arrangement requires at least sufficient space at one side of the clevis to extend the full cylinder bore which, in certain applications, is not available.

In view of the above, it would be significantly beneficial if an actuating mechanism could be developed which can be mounted in such a way that the full length of the cylinder bore of the mechanism need not extend in a single direction away from the mounting structure to which it is attached. It would also be highly desirable if this type of mounting mechanism could assure that the forces, resulting from the actuation of the mechanism, pass through the rod of the cylinder and through a line which intersects the points at which the cylinder housing is supported by the external support structure.

SUMMARY OF THE INVENTION

An actuating mechanism made in accordance with the present invention comprises a cylinder housing with a cylinder bore formed therein, with the cylinder bore extending along a central axis between a first end and a second end of the cylinder bore. A piston is disposed within the cylinder bore and is moveable between first and second ends of the cylinder bore in response to changes in the relative magnitudes of pressure on opposites sides of the piston within the cylinder bore. A rod is attached to the piston and extends through the cylinder housing at the first end of the cylinder bore.

A first support member is attached to the cylinder housing and has a first mounting hole formed therein. The first mounting hole extends through the first support member in a direction generally perpendicular to the central axis of the cylinder bore at a point along the central axis between the first and second ends. The first support member is spaced apart from the cylinder housing to receive a first external structure between the first support member and the cylinder housing. The first external support structure is attachable to the first support member at the first hole.

A second support member is attached to the cylinder housing and has a second mounting hole formed therein. The second mounting hole extends through the second support member in a direction generally perpendicular to the central axis of the cylinder bore at a point along the central axis between the first end and the second end. The second support member is spaced apart from the cylinder housing to receive a second external structure between the second support member and the cylinder housing. The second external support structure is attachable to the second support member at the second hole.

As a result of the above structure, an imaginary line extending between the first and second holes of the first and second support members, respectively, intersects the cylinder bore between the first and second ends.

The first and second external support structures can be portions of a clevis device with a space between them that is shaped to receive the cylinder housing with the first and second external support structures both being disposed between the first and second support members. The piston can be moveable within the cylinder bore in response to hydraulic pressure changes within the cylinder bore or, alternatively, in response to pneumatic pressure changes within the cylinder bore. The first and second external support structures can be attached to a transom of a marine vessel, and the rod can be attached to a steering lever of a marine propulsion device.

BRIEF DESCRIPTION OF THE DRAWINGS

The present invention will be more fully and completely understood from a reading of the description of the preferred embodiment in conjunction with the drawings, in which.

DESCRIPTION OF PREFERRED EMBODIMENT

Figure 1:
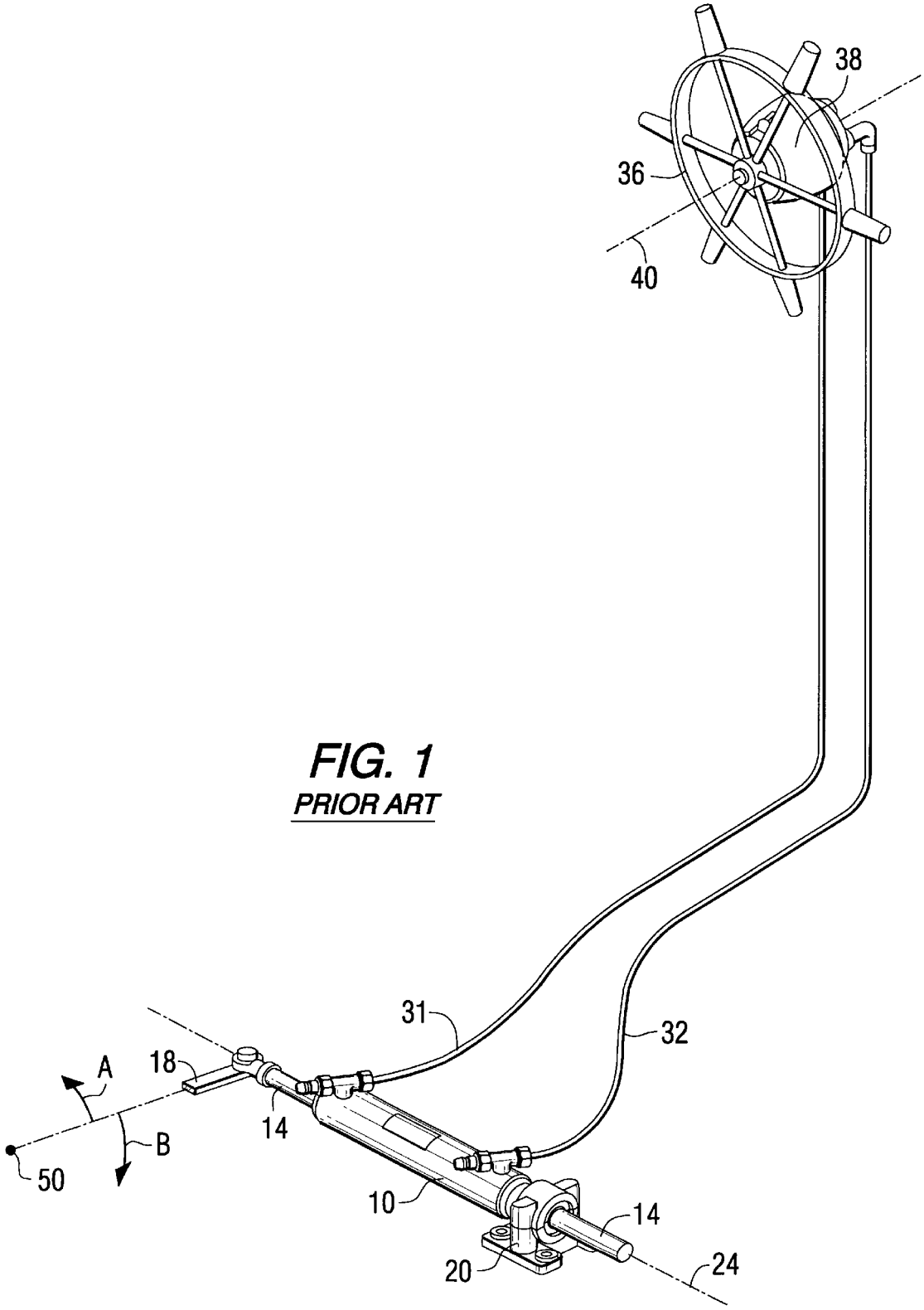
FIG. 1 PRIOR ART
FIG. 1 is a schematic representation of a known steering system.

Throughout the description of the preferred embodiment of the present invention, like components will be identified by like reference numerals.

FIG. 1 shows a common way of arranging an actuating system for a marine vessel. A cylinder housing 10 has a cylinder bore formed therein. The bore is not illustrated in FIG. 1. A rod 14 extends through the cylinder housing and bore and is connected to a piston within the cylinder bore. As shown in FIG. 1, one end of the rod 14 is attached to a steering lever 18. The steering lever 18 is attached to a marine propulsion device, such as an outboard motor, a stern drive unit or a rudder, depending on the type of marine vessel with which the system is used. The cylinder housing 10 is attached to a support component 20 and the rod 14 extends through the support component 20. It should be understood that the rod 14 moves along the central axis 24 of the cylinder bore and the rod 14.

Two hydraulic lines, 31 and 32, are connected in fluid communication with the cylinder bore within the housing at opposite sides of the piston which is attached to the rod 14. The helm 36 is provided with a fluid supply mechanism 38 that causes fluid to flow through the two hydraulic lines, 31 and 32, in a manner which moves the rod 14 in a desired direction along central axis 24. In other words, when the helm 36 is turned clockwise about its axis 40, hydraulic fluid is caused to flow downward through hydraulic line 32 into the cylinder bore. Hydraulic fluid also flows upward through hydraulic line 31 from the cylinder bore toward the mechanism 38. As a result, the rod 14 moves in the direction represented by arrow A in FIG. 1, and the marine vessel turns toward starboard. If, on the other hand, the helm 36 is rotated counterclockwise about centerline 40, the flow of hydraulic fluid would be down through hydraulic line 31 to the cylinder bore and up through hydraulic line 32 away from the cylinder bore. This would cause rod 14 to move in an opposite direction along central axis 24, and the steering lever 18 would be moved about point 50 in the direction represented by arrow B. This would cause the marine vessel to move toward port. The arrangement illustrated schematically in FIG. 1 is well-known to those skilled in the art and is typically used on marine vessels with inboard propulsion systems.

Figure 2:
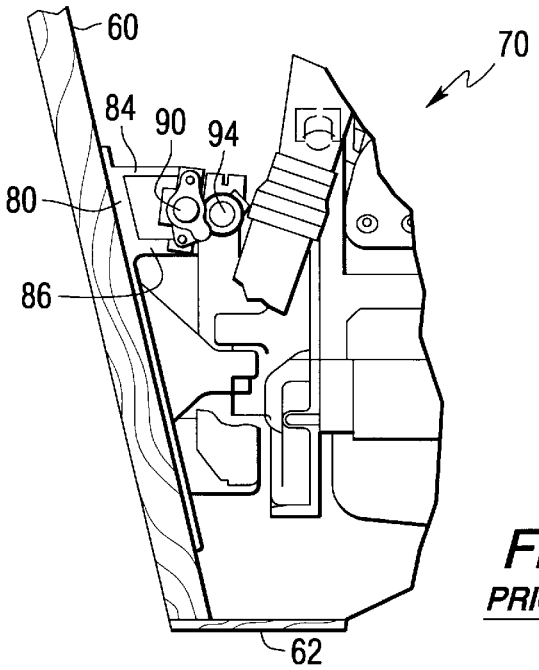
FIG. 2 PRIOR ART
FIG. 2 shows the mounting bracket used to support an actuating cylinder of a steering system for a marine vessel.

FIG. 2 illustrates a known arrangement for attaching a steering mechanism to a marine vessel. In FIG. 2, the transom 60 of a marine vessel is shown in section view, along with a portion of the bottom 62 of a marine vessel. An engine, identified generally by reference numeral 70, is located within the structure of the marine vessel. A support bracket 80 is attached to the transom 60 of the boat and is typically provided with a clevis structure having a first external support structure 84 and a second external support structure 86 extending from the bracket which is attached to the transom 60. In FIG. 2, reference numeral 90 identifies an axial end of a cylinder mechanism which is attached to the first and second external support structures, 84 and 86. Also shown in FIG. 2 is a control valve 94 that is used in conjunction with certain actuating cylinders. However, it should be clearly understood that the actuating valve 94 is not a requirement on all embodiments of the present invention.

Figure 3:
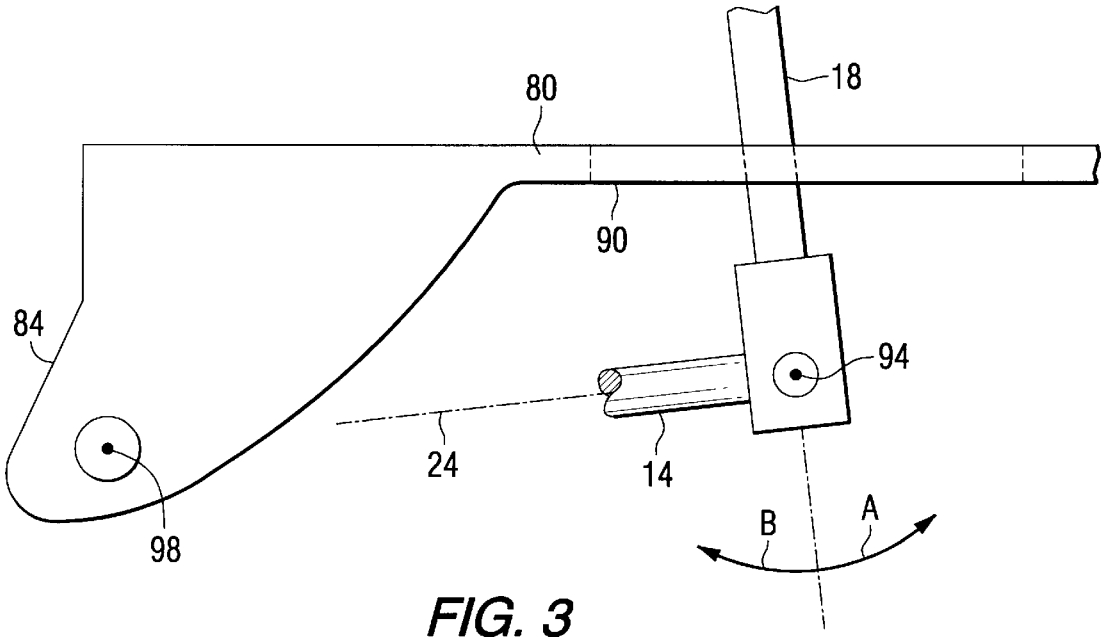
FIG. 3 PRIOR ART
FIG. 3 is a top view of the support bracket shown in FIG. 2.

FIG. 3 is the top view of the support bracket 80 described above in conjunction with FIG. 2. The bracket is provided with an opening 90 extending through the bracket and through the transom of the boat. The steering lever 18 extends through the opening 90 and is attachable to the rod 14 by an appropriate fastener which allows lever 18 and rod 14 to pivot relative to each other about point 94. A cylinder housing (not shown in FIG. 3) is attached to the first and second external support structures, 84 and 86, in such a way that it is able to pivot about point 98. Although the cylinder housing is not illustrated in FIG. 3, the central axis 24 extending through the rod 14 and the cylinder bore illustrates the relative positions of the components. Ideally, central axis 24 should pass through points 94 and 98 to minimize bending torque that could otherwise stress the components.

Figure 4:
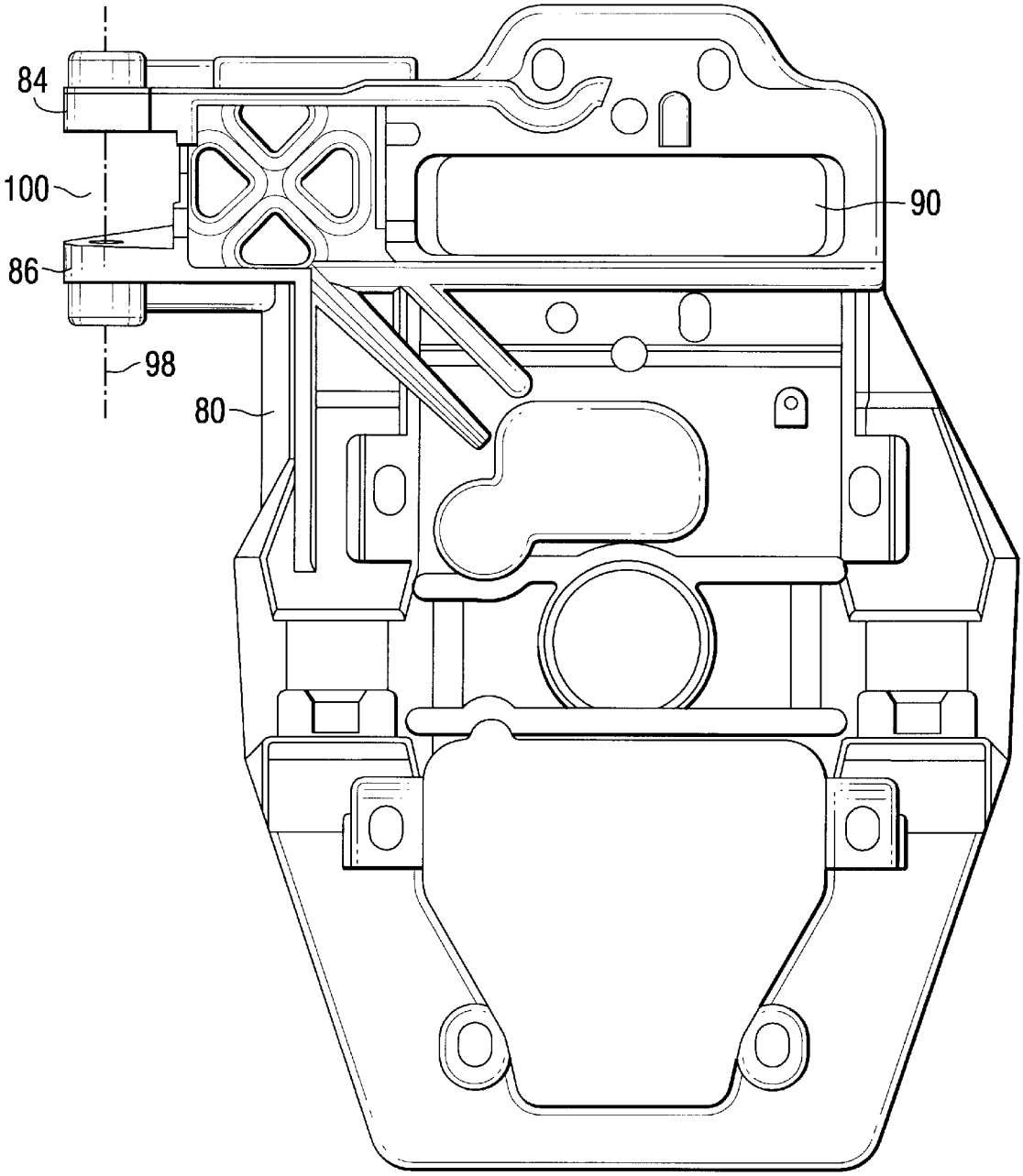
FIG. 4 PRIOR ART
FIG. 4 is a frontal view of the support bracket illustrated in FIGS. 2 and 3.

FIG. 4 is another view of the support bracket 80 shown, as a side view, in FIG. 2 and, as a partial view, in FIG. 3. The bracket 80 is provided with the opening 90 that allows the steering lever 18 to move within it in response to movement of the rod 14 of the actuating cylinder. The first and second external support structures, 84 and 86, are ears of a clevis which provide a space 100 between them. Axis 98 is the axis about which the cylinder housing is intended to pivot to allow for the changing angular relationships of the components when the rod 14 is extended out of and back into the cylinder bore. Bolts, or other appropriate fasteners, are extended through the first and second external support structures, 84 and 86, to attach the cylinder housing to the clevis.

Figure 5:
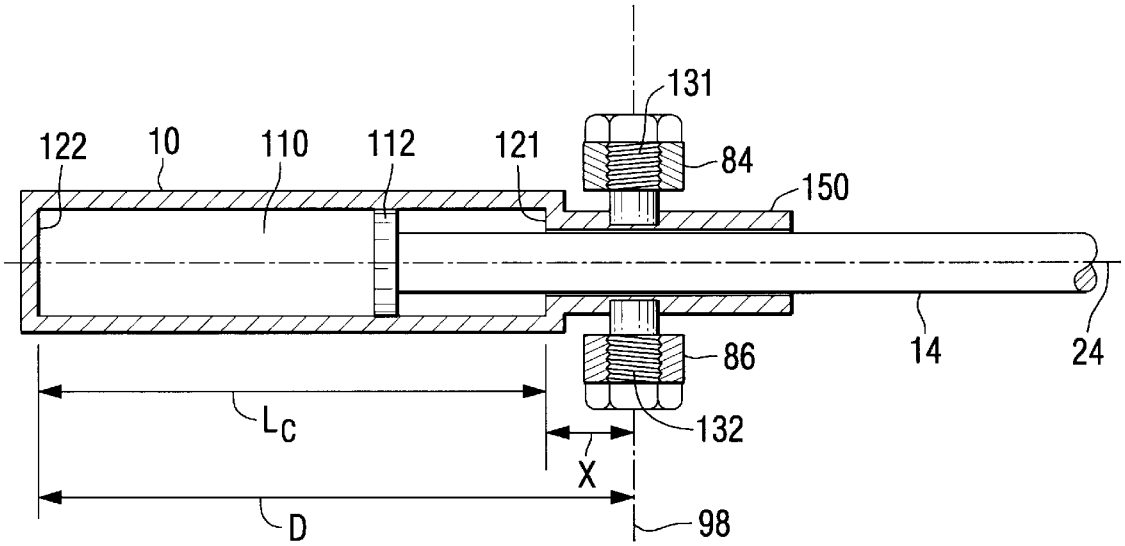
FIG. 5 PRIOR ART
FIG. 5 is a sectional view showing a known mounting system for an actuating cylinder.

FIG. 5 shows the common way that a cylinder housing 10 is attached to the first and second external support structures, 84 and 86, of the clevis. Within the cylinder housing 10, a cylinder bore 110 is formed. A piston 112 is disposed within the cylinder bore 110 and is attached to the rod 14 described above in conjunction with FIGS. 1 and 3. In a manner that is well-known to those skilled in the art, hydraulic or pneumatic pressures on opposite sides of the piston 112, within the cylinder bore 110, are changed in order to move the piston back and forth within the cylinder bore 110 between a first end 121 and a second end 122. The distance between the first and second ends, 121 and 122, of the cylinder bore is identified in FIG. 5 as $L_C$ and this distance, minus the thickness of the piston 112, generally represents the travel of the rod 14 from one maximum extreme to the opposite maximum extreme. For purposes of reference, dimension D identifies the distance between the second end 122 of the cylinder bore 110 and axis 98 about which the cylinder housing can rotate as a result of its attachment to the first and second external support structures, 84 and 86, by fasteners 131 and 132.

With continued reference to FIG. 5, it can be seen that distance D is larger than the length of the cylinder bore $L_C$ by a magnitude which is identified as dimension X. The magnitude of dimension X results from the fact that known methods for attaching the cylinder housing 10 to the support clevis do not permit the fasteners, 131 and 132, to extend directly into the housing 10 in the region where the cylinder bore 110 is located. There are several reasons for this restriction. First, it is desirable to make the cylinder bore 110 with a maximum diameter to achieve higher force capabilities given a fixed hydraulic or pneumatic pressure limitation. Secondly, fastening holes formed in the body of the housing 10 surrounding the cylinder bore 110 would weaken the integrity of the structure. Thirdly, the distance between the first and second external support structures, 84 and 86, is limited in certain applications and usually the space 100 between the two ears of the clevis is barely large enough to accept the housing 10 without allowing space to accommodate the needs of the fasteners, 131 and 132. Therefore, the fasteners are typically threaded into a portion of the external support structures which do not surround the cylinder bore 110 but, instead, surrounds a portion of the rod 14. This part of the housing structure 10 is identified by reference numeral 150 in FIG. 5. Holes are formed in this part 150 to receive a pin on the end of the fasteners, 131 and 132, to pivotally support the housing 10 and allow it to pivot about axis 98 as shown in FIG. 5. Because of the need to provide a dimension X as illustrated in FIG. 5, distance D is necessarily larger in magnitude than the dimension $L_C$ between the first and second ends, 121 and 122, of the cylinder bore 110.

In certain applications, particularly in conjunction with marine vessels and marine propulsion systems, it is desirable to minimize the magnitude of dimension D because of limited space near the transom of the vessel.

Figure 6:
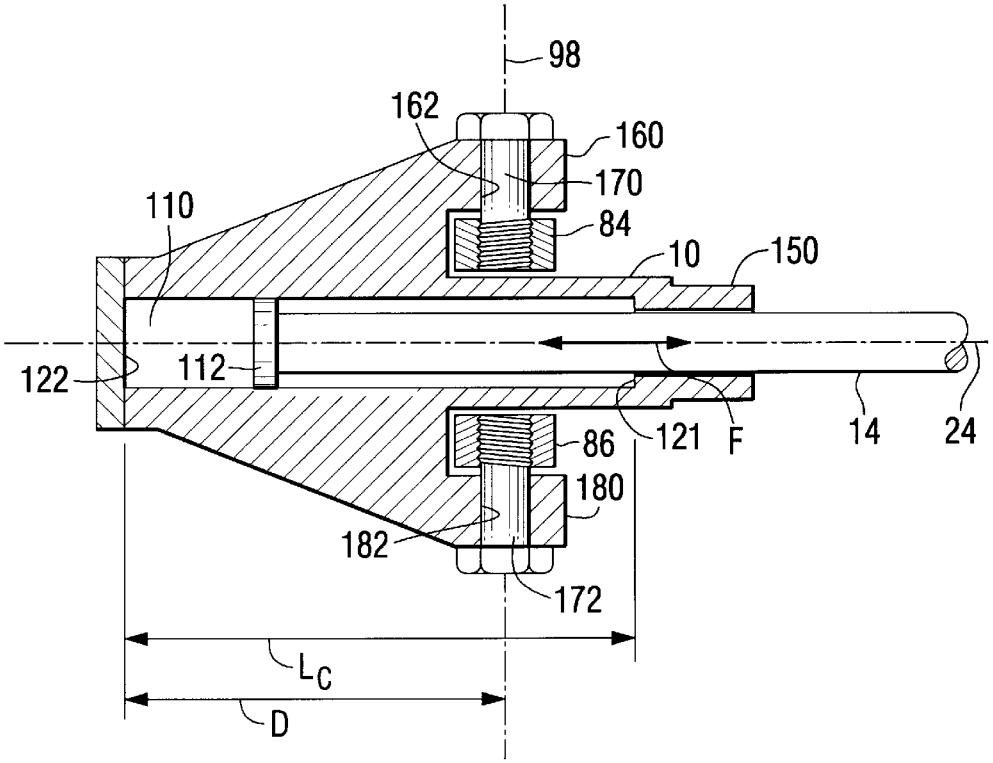
FIG. 6 is a sectional view of the present invention.

FIG. 6 illustrates how the present invention mounts the cylinder housing 10 in such a way that distance D is actually less than the length $L_C$ of the cylinder bore 110 between the first and second ends, 121 and 122. In FIG. 6, the present invention is shown as comprising a cylinder housing 10 which has a cylinder bore 110 formed therein. The cylinder bore 110 extends along the central axis 24 between a first end 121 and a second end 122 of the cylinder bore 110. The piston 112 is disposed within the cylinder bore 110 and is moveable between the first and second ends, 121 and 122, of the cylinder bore 110 in response to relative magnitudes of pressure on opposite sides of the piston 112 within the cylinder bore. The rod 14 is attached to the piston 112 and extends through the cylinder housing 10 at the first end 121 of the cylinder bore 110. A first support member 160 is attached to the cylinder housing 10 and has a first mounting hole 162 formed therein. The first mounting hole 162 extends through the first support member 160 in a direction that is generally perpendicular to the central axis 24 of the cylinder bore 110 at a point along the central axis between the first end 121 and second end 122. In other words, axis 98 intersects axis 24 between the ends of the cylinder bore 110. This is a valuable asset of the present.

The first support member 160 is spaced apart from the cylinder housing 10 in order to receive the first external structure 84 between the first support member 160 and the cylinder housing 10. The first external support structure 84 is attachable to the first support member 160 at the first hole 162 through the use of fastener 170.

At an opposite side of the cylinder housing 10, a second support member 180 is attached to the cylinder housing 10 and has a second mounting hole 182 extending through the second support member in a direction generally perpendicular to the central axis 24 of the cylinder bore 110 at a point along the central axis between the first and second ends, 121 and 122, of the cylinder bore. The second support member 180 is spaced apart from the cylinder housing 10 in order to receive a second external support structure 86 between the second support member 180 and the cylinder housing 10. The second external support structure 86 is attachable to the second support member 180 at the second hole 182. This attachment is provided by fastener 172.

With continued reference to FIG. 6, it can be seen that a line 98, extending between the first and second holes, 162 and 182, of the first and second support members, 160 and 180, intersects the cylinder bore 110 between the first and second ends, 121 and 122. In a particularly preferred embodiment of the present invention, line 98 and line 24 intersect each other. This causes any resulting force F to pass through the pivot axis 98 and along the central axis 24 of the rod 14. Although not absolutely required in all embodiments of the present invention, this arrangement between force F and the axes, 24 and 98, is advantageous because it minimizes bending moments that could otherwise stress the components of the mechanism.

As a result of the present invention, as illustrated in FIG. 6, dimension D is less than the length of the cylinder bore 110. The required distance to the left of axis 98 is significantly less than that which is required by the prior art structure as shown in FIG. 5. Even though the length $L_C$ of the cylinder bore 110 is identical in both examples shown in FIGS. 5 and 6, the required space to perform the actuation of the steering mechanism is significantly reduced. The use of the first and second support members, 160 and 180, which are attached to the cylinder housing 10, allows a mounting scheme which places the support members outside of the first and second external support structures, 84 and 86, and reserves all of the space between those structures for use by the cylinder housing 10. This allows the cylinder housing 10 to be moved toward the right in FIG. 6 to reduce the required distance D toward the left of axis 98. In conventional mounting schemes such as that illustrated in FIG. 5, it is necessary to provide an extended part 150 of the cylinder structure into which the fasteners, 131 and 132, can be inserted. This requirement is eliminated in the present invention and, although a short part 150 is included as part of the overall structure in FIG. 6, the fasteners, 170 and 172, do not intersect part 150 or the cylinder housing 10. The extended support members, 160 and 180, perform this function in such a way that dimension D is reduced. Although not shown in FIG. 6, rod 14 is typically attached to the steering lever 18 described above in conjunction with FIGS. 1 and 3 at the distal end of the rod 14 which is not shown in FIG. 6. With reference to FIGS. 3 and 6, it can be seen that an extension of rod 14 from the cylinder housing 10 will cause the steering lever 18 to rotate in the direction represented by arrow A. To allow for this movement, the rod 14 is allowed to pivot relative to the steering lever 18, about point 94, and the cylinder housing 10 is allowed to pivot about axis 98 which is defined by the holes in the first and second support members, 160 and 180, and the fasteners, 170 and 172, which extend through those holes and attach the first and second support members to the first and second external support structures, 84 and 86.

Figure 7:
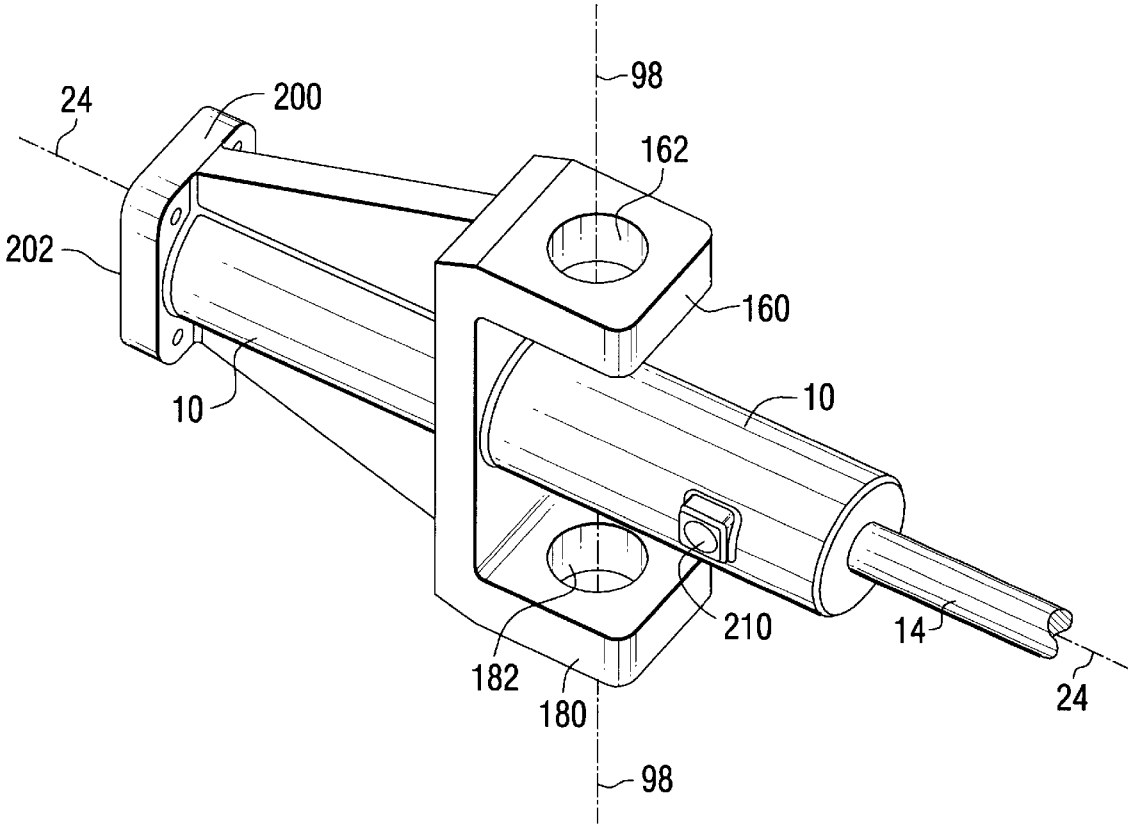
FIG. 7 is a perspective view of an actuating mechanism made in accordance with the present invention.

FIG. 7 is a perspective view of the present invention without the fasteners, 170 and 172, and without the first and second external support structures, 84 and 86. In the particular embodiment shown in FIG. 7, a flange 200 is provided at one end of the cylinder housing 10 to allow a cover (not shown in FIG. 7) to be attached to the flange 200 to close the second end 122 of the cylinder bore. In other words, the surface 202 of flange 200 is intersected by the cylinder bore and is closed and sealed by the cover.

A fluid port 210 is provided to allow conduits, such as hydraulic lines 31 and 32 in FIG. 1, to be connected to the cylinder housing 10. Another fluid port would typically be provided in the cover that can be attached to flange 200. Fluid port 210 allows hydraulic or pneumatic fluid to flow into and out of the cylinder bore between the piston 112 and the first end 121 of the cylinder bore 110, as illustrated in FIG. 6. The other fluid port in the cover attached to flange 200 would allow hydraulic or pneumatic fluid to flow into or out of the cylinder bore 110 between piston 112 and the second end 122 of the cylinder bore. This allows the piston to be moved axially within the cylinder bore to cause rod 14 to move axially along its central axis 24. The first and second holes, 162 and 182, are aligned along axis 98 to allow the structure to be supported by the first and second external support structures described above. As can be seen in FIG. 7, axis 98 intersects the cylinder bore (not shown in FIG. 7) at a point between the ends of the cylinder bore. This allows a minimization of dimension D described above in conjunction with FIG. 6, while retaining the same piston stroke that would otherwise be available in a cylinder made in accordance with the prior art.

With continued reference to FIG. 7, it can be seen that space is provided between the first support member 160 and the cylinder housing 10 and also between the second support member 180 and the cylinder housing 10 to receive the ears of the clevis which are described above as the first and second external support structures, 84 and 86, which are attached to the transom of a marine vessel.

The present invention provides an efficient method for attaching an actuator to a stationary component, such as the transom of a boat, in such a way that the minimum dimension at one side of the support structure is decreased. In certain applications, space is limited in the region near the transom and prior art actuators require at least sufficient space to one side of the support mechanism to allow the entire cylinder bore length to extend from the support structure. The present invention eliminates that requirement and thereby reduces the overall spatial requirement of the steering mechanism. It should be understood that, although the present invention has been described with considerable detail and illustrated with particular specificity, alternative embodiments are also within the scope of the invention. For example, the concept of the present invention can be used with both hydraulic and pneumatic systems. The invention is applicable for power steering applications or hydraulic steering systems which do not provide a power steering capability. Furthermore, the system can be used in conjunction with outboard motors, stern drive units or inboard systems. In addition, the present invention can be used in non-marine applications and virtually in any application where a cylinder housing must be mounted in an application where space is limited.

We claim:

1. An actuating mechanism, comprising:

a cylinder housing having a cylinder bore formed therein, said cylinder bore extending along a central axis between a first end and a second end of said cylinder bore;

a piston disposed within said cylinder bore and movable between said first and second ends of said cylinder bore in response to the relative magnitudes of pressure on opposite sides of said piston within said cylinder bore;

a rod attached to said piston and extending through said cylinder housing at said first end of said cylinder bore;

a first support member attached to said cylinder housing and having a first mounting hole formed therein, said first mounting hole extending through said first support member in a direction generally perpendicular to said central axis of said cylinder bore at a point along said central axis between said first end and said second end, said first support member being spaced apart from said cylinder housing to receive a first external support structure between said first support member and said cylinder housing, said first external support structure being attachable to said first support member at said first hole;

a second support member attached to said cylinder housing and having a second mounting hole formed therein, said second mounting hole extending through said second support member in a direction generally perpendicular to said central axis of said cylinder bore at a point along said central axis between said first end and said second end, said second support member being spaced apart from said cylinder housing to receive a second external support structure between said second support member and said cylinder housing, said second external support structure being attachable to said second support member at said second hole; and whereby a line extending between said first and second holes of said first and second support members, respectively, intersects said cylinder bore between said first and second ends.

2. The mechanism of claim 1, wherein:

said first and second external support structures are portions of a clevis with a space between them shaped to receive said cylinder housing with said first and second external support structures being disposed between said first and second support members.

3. The mechanism of claim 1, wherein:

said piston is movable within said cylinder bore in response to hydraulic pressure changes within said cylinder bore on opposite sides of said piston.

4. The mechanism of claim 1, wherein:

said piston is movable within said cylinder bore in response to pneumatic pressure changes within said cylinder bore on opposite sides of said piston.

5. The mechanism of claim 1, wherein:

said first and second external support structures are attached to a transom of a marine vessel.

6. The mechanism of claim 1, wherein:

said rod is attached to a steering lever of a marine propulsion device.

7. An actuating mechanism, comprising:

a cylinder housing having a cylinder bore formed therein, said cylinder bore extending along a central axis between a first end and a second end of said cylinder bore;

a piston disposed within said cylinder bore and movable between said first and second ends of said cylinder bore in response to the relative magnitudes of pressure on opposite sides of said piston within said cylinder bore;

a rod attached to said piston and extending through said cylinder housing at said first end of said cylinder bore;

a first support member attached to said cylinder housing and having a first mounting hole formed therein, said first mounting hole extending through said first support member in a direction generally perpendicular to said central axis of said cylinder bore at a point along said central axis between said first end and said second end, said first support member being spaced apart from said cylinder housing to receive a first external support structure between said first support member and said cylinder housing, said first external support structure being attachable to said first support member at said first hole;

a second support member attached to said cylinder housing and having a second mounting hole formed therein, said second mounting hole extending through said second support member in a direction generally perpendicular to said central axis of said cylinder bore at a point along said central axis between said first end and said second end, said second support member being spaced apart from said cylinder housing to receive a second external support structure between said second support member and said cylinder housing, said second external support structure being attachable to said second support member at said second hole, said first and second external support structures being portions of a clevis with a space between them shaped to receive said cylinder housing with said first and second external support structures being disposed between said first and second support members; and whereby a line extending between said first and second holes of said first and second support members, respectively, intersects said cylinder bore between said first and second ends.

8. The mechanism of claim 7, wherein:

said piston is movable within said cylinder bore in response to hydraulic pressure changes within said cylinder bore on opposite sides of said piston.

9. The mechanism of claim 8, wherein:

said first and second external support structures are attached to a transom of a marine vessel.

10. The mechanism of claim 9, wherein:

said rod is attached to a steering lever of a marine propulsion device.

11. The mechanism of claim 7, wherein:

said piston is movable within said cylinder bore in response to pneumatic pressure changes within said cylinder bore on opposite sides of said piston.

12. An actuating mechanism, comprising:

a cylinder housing having a cylinder bore formed therein, said cylinder bore extending along a central axis between a first end and a second end of said cylinder bore;

a piston disposed within said cylinder bore and movable between said first and second ends of said cylinder bore in response to the relative magnitudes of pressure on opposite sides of said piston within said cylinder bore, said piston being movable within said cylinder bore in response to hydraulic pressure changes within said cylinder bore on opposite sides of said piston;

a rod attached to said piston and extending through said cylinder housing at said first end of said cylinder bore;

a first support member attached to said cylinder housing and having a first mounting hole formed therein, said first mounting hole extending through said first support member in a direction generally perpendicular to said central axis of said cylinder bore at a point along said central axis between said first end and said second end, said first support member being spaced apart from said cylinder housing to receive a first external support structure between said first support member and said cylinder housing, said first external support structure being attachable to said first support member at said first hole;

a second support member attached to said cylinder housing and having a second mounting hole formed therein, said second mounting hole extending through said second support member in a direction generally perpendicular to said central axis of said cylinder bore at a point along said central axis between said first end and said second end, said second support member being spaced apart from said cylinder housing to receive a second external support structure between said second support member and said cylinder housing, said second external support structure being attachable to said second support member at said second hole, said first and second external support structures being portions of a clevis with a space between them shaped to receive said cylinder housing with said first and second external support structures being disposed between said first and second support members; and whereby a line extending between said first and second holes of said first and second support members, respectively, intersects said cylinder bore between said first and second ends.

13. The mechanism of claim 12, wherein:

said first and second external support structures are attached to a transom of a marine vessel.

14. The mechanism of claim 13, wherein:

said rod is attached to a steering lever of a marine propulsion device.

* * * * *